US005795081A

United States Patent [19]

Miyaji

[11] Patent Number: 5,795,081

[45] Date of Patent: Aug. 18, 1998

[54] LINE PRINTER

[75] Inventor: Kazuo Miyaji, Tokyo, Japan

[73] Assignee: Fuji Photo Film Co., Ltd., Kanagawa, Japan

[21] Appl. No.: 536,501

[22] Filed: Sep. 28, 1995

[30] Foreign Application Priority Data

Oct. 12, 1994 [JP] Japan ..... 6-246156

[51] Int. Cl.[6] ..... B41J 02/36

[52] U.S. Cl. ..... 400/120.07; 347/184

[58] Field of Search ..... 400/120.09, 120.07; 347/183, 184

[56] References Cited

U.S. PATENT DOCUMENTS 5,242,230 9/1993 Arakawa ..... 400/692

FOREIGN PATENT DOCUMENTS 215543 8/1989 Japan ..... 400/120.07

236277 9/1993 Japan ..... 400/120.07

*Primary Examiner*—Edgar S. Burr

*Assistant Examiner*—Steven S. Kelley

[57] ABSTRACT

A line printer including a device for receiving gradation scale values of pixels for one line to be printed, and a plurality of tables for correcting a density variation caused by common resistance unevenness. The line printer further includes a device for arithmetically obtaining a number of printing elements to be operated for each gradation scale for printing from the gradation scale values of the pixels for one line received by the receiving device, and a device for retrieving an optimal table from the plurality of tables on the basis of the number of printing elements obtained by the arithmetic device.

12 Claims, 3 Drawing Sheets

FIG. 4A

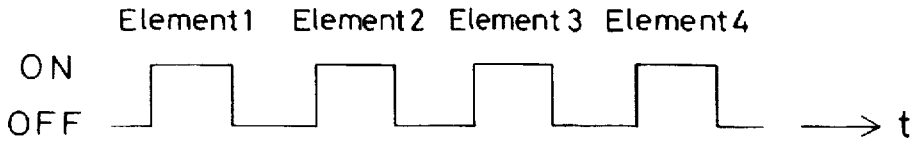

FIG. 4B

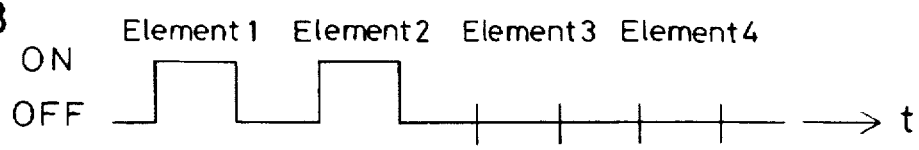

FIG. 5

| | | |
|---|---|---|
| 09FFH | Page 9 | STB pulse width data for scale 255 |
| | | ⋮ |
| | | STB pulse width data for scale 1 |
| 0900H | | STB pulse width data for scale 0 |
| 08FFH | Page 8 | STB pulse width data for scale 255 |
| | | ⋮ |
| | | STB pulse width data for scale 1 |
| 0800H | | STB pulse width data for scale 0 |
| 07FFH | ⋮ | ⋮ |
| 0200H | | |
| 01FFH | Page 1 | STB pulse width data for scale 255 |
| | | ⋮ |
| | | STB pulse width data for scale 1 |
| 0100H | | STB pulse width data for scale 0 |
| 00FFH | Page 0 | STB pulse width data for scale 255 |
| | | ⋮ |
| | | STB pulse width data for scale 1 |
| 0000H | | STB pulse width data for scale 0 |

LINE PRINTER

BACKGROUND OF THE INVENTION

1. Field of the Invention

The present invention relates to a line printer. More particularly, the present invention relates to a line printer employing a line head based on a parallel input system, wherein density variation, which is known as common resistance unevenness, is effectively corrected.

2. Description of the Background Art

It is known that a line printer employing a line head involves density variation which is caused by a common resistance. The density variation will be explained below.

It is known that an equivalent circuit of a line head is such as that shown in FIG. 2A. In the figure, reference symbol $R_C$ denotes a common resistance, and $R_0, R_1, \ldots, R_n$ denote the respective resistances of heating elements.

Assuming that the resistance of elements which are heating up (hereinafter referred to as "heating elements") is represented by the total resistance $R_H$, the equivalent circuit is simplified as shown in FIG. 2B. In this case, although the common resistance $R_C$ itself does not change, the total resistance $R_H$ varies according to the number of heating elements. Consequently, since the common resistance $R_C$ and the total resistance $R_H$ are connected in series, the voltage with respect to the total resistance $R_H$ varies, causing variation of the current flowing through each heating element, which results in a density variation in the printed image.

The above is the density variation caused by the common resistance, which is also called "common resistance unevenness".

It should be noted that the term "printing" as used in this specification shall include not only printing of characters but also printing of images.

Various methods of correcting the density variation caused by the common resistance have heretofore been proposed. In recent years, however, the following technique has been adopted in many of conventional line printers. That is, a line printer is provided with a plurality of tables containing data concerning the pulse width of a strobe (hereinafter referred to as "STB") pulse that specifies a heating time of a thermal element for each particular gradation scale value. For each printing for each particular gradation scale value, a number of thermal elements to be heated is counted, and an optimal table (hereinafter referred to as "common table") is selected from among the plurality of tables on the basis of the counted number of thermal elements to be heated. Then, an STB pulse width corresponding to the relevant gradation scale value is read out from the common table, and an STB pulse having the read pulse width is applied to the thermal elements which are to be heated.

FIG. 3 schematically shows an example of the arrangement of a line printer adopting the above-described technique.

FIG. 3 shows an example of the arrangement of a line printer which employs a line head based on a serial input system. A line memory 1 has been stored with density values of pixels for one line read out from a frame memory (not shown). Let us assume that there are 256 gray scales from 0 to 255 in this example.

A data transfer control circuit 2 generates and outputs an ON/OFF signal for each pixel for each gradation scale of information to be printed on the basis of the density value of each of the pixels stored in the line memory 1. Further, the data transfer control circuit 2 outputs a print scale signal, which indicates a gradation scale for which the presently outputted ON/OFF signal is to be used, to a look-up table (hereinafter referred to as "LUT") 6. Since there are 256 gradation scales for density in this example, the print scale signal has a value in the range of from $00_H$ to $FF_H$ (the subscript H indicates a hexadecimal number; the same shall apply hereinafter). In other words, the print scale signal in this example is an 8-bit signal.

The above-mentioned ON/OFF signal will be explained below. The ON/OFF signal specifies whether or not each thermal element (hereinafter referred to as simply "element") of a line head 4 should heat up during printing carried out for the relevant gradation scale. For example, in a case where the number of elements of the line head 4 is 4, and all the elements should heat up during printing for the scale 0, the data transfer control circuit 2 generates and outputs a pulse signal such as that shown in FIG. 4A.

In FIG. 4A: the first pulse specifies whether or not a first element 1 should heat up; the second pulse specifies whether or not a second element 2 should heat up; the third pulse specifies whether or not a third element 3 should heat up; and the fourth pulse specifies whether or not a fourth element 4 should heat up. When a pulse is at the ON level, the relevant element heats up; when the pulse is at the OFF level, the element does not heat up.

Thus, when the ON/OFF signal as shown in FIG. 4A is outputted, all the elements 1 to 4 heat up, and printing for the relevant gradation scale, that is, the scale 0 in this case, is carried out.

Upon completion of the printing for the scale 0, the data transfer control circuit 2 generates an ON/OFF signal for the scale 1 to carry out subsequent printing for the scale 1. Assuming, for example, that the density value for pixels corresponding to the elements 1 and 2 is not less than 1, and the density value for pixels corresponding to the elements 3 and 4 is 0, when printing for the scale 1 is to be carried out, the elements 1 and 2 need to heat up, but the elements 3 and 4 need not heat up. In this case, therefore, the data transfer control circuit 2 generates and outputs an ON/OFF signal such as that shown in FIG. 4B.

In this way, the data transfer control circuit 2 generates an ON/OFF signal every time printing for each particular gradation scale is to be carried out up to the scale 255. Accordingly, when the density value of a certain pixel is n (where $0 \leqq n \leqq 255$), the level of the ON/OFF signal for an element corresponding to that pixel is set to the ON level during printing carried out for scales in the range of from 0 to n, while it is set to the OFF level during printing for scales in the range of from (n+1) to 255.

A head driving circuit 3 drives the line head 4. Since such a circuit is well known, description thereof is omitted.

The line head 4 comprises an array of a predetermined number of elements. The number of elements in this example is assumed to be 2,560.

A counter 5 detects a rise of the ON/OFF signal outputted from the data transfer control circuit 2 to count the number of pulses which are at the ON level in the ON/OFF signal. That is, the counter 5 counts the number of elements which are to be heated during printing for the relevant scale. The counter 5 outputs a count value; in this example, it is assumed that the counter 5 outputs only high-order 4 bits of the count value.

An LUT 6 has a plurality of tables containing data concerning the value of an STB pulse width corresponding to each of scales 0 to 255. The LUT 6 outputs STB pulse data to the head driving circuit 3, using the count value of the counter 5 and the value of the print scale signal as addresses. More specifically, on the basis of the count value of the counter 5, a table which corresponds to the relevant count value is selected from among the plurality of tables, and data concerning an STB pulse corresponding to the value of the print scale signal is read out from the selected table, as will be clear from a description made later.

In this example, it is assumed that 10 tables are prepared, and these tables are assigned page addresses 0 to 9, respectively. Further, it is assumed that: when the number of heating elements is in the range of from 0 to 255, the table with the page address 0 is used; when the number of heating elements is in the range of from 256 to 511, the table with the page address 1 is used; when the number of heating elements is in the range of from 512 to 767, the table with the page address 2 is used; when the number of heating elements is in the range of from 768 to 1,023, the table with the page address 3 is used; when the number of heating elements is in the range of from 1,024 to 1,279, the table with the page address 4 is used; when the number of heating elements is in the range of from 1,280 to 1,535, the table with the page address 5 is used; when the number of heating elements is in the range of from 1,536 to 1,791, the table with the page address 6 is used; when the number of heating elements is in the range of from 1,792 to 2,047, the table with the page address 7 is used; when the number of heating elements is in the range of from 2,048 to 2,303, the table with the page address 8 is used; and when the number of heating elements is in the range of from 2,304 to 2,560, the table with the page address 9 is used.

Accordingly, the LUT 6 may be arranged as shown in FIG. 5. In the figure, the table with the page address 0 is assigned to regions $0000_H$ to $00FF_H$ in the memory, and these regions are stored with data concerning STB pulse widths corresponding to printing operations for the scales 0 to 255. The same is the case with the other tables. It is apparent to those skilled in the art that the STB pulse width corresponding to each scale, which has been written in each table, can be determined by an appropriate calculation, experiment, etc.

The LUT 6 is supplied with the 4-bit signal from the counter 5 as the high-order 4 bits of an address in the LUT 6, and also supplied with the 8-bit print scale signal from the data transfer control circuit 2 as the low-order 8 bits of an address in the LUT 6.

Accordingly, if it is assumed that printing for the scale 0 is to be carried out, and the number of elements to be heated is 2,400, $00_H$ is inputted to the LUT 6 from the data transfer control circuit 2, and $9_H$ is inputted to the LUT 6 from the counter 5. Consequently, the table with the page address 9 is selected from the LUT 6 as a common table, and data concerning the STB pulse width for the scale 0 is read out from the selected table and then supplied to the head driving circuit 3. Thus, the elements which are to heat up during this printing process are heated only for a time which is specified by the pulse width data by the operation of the head driving circuit 3. In this way, printing for the scale 0 is carried out.

Upon completion of the printing for the scale 0, printing for the scale 1 is then carried out. Assuming that the number of elements to be heated during the printing process is 2,100, $01_H$ is inputted to the LUT 6 from the data transfer control circuit 2, and $8_H$ is inputted to the LUT 6 from the counter 5. Consequently, the table with the page address 8 is selected from the LUT 6 as a common table, and data concerning an STB pulse width for the scale 1 is read out from the selected table and then supplied to the head driving circuit 3. Thus, the elements which are to heat up during this printing process are heated only for a time which is specified by the pulse width data by the operation of the head driving circuit 3. In this way, printing for the scale 1 is carried out.

Thereafter, the above-described operation is repeated up to the scale 255, thereby completing printing for 1 line.

According to the above-described arrangement, a common table can be selected according to the number of elements to be heated. Therefore, the density variation caused by the common resistance can be effectively corrected. It should be noted that, although the foregoing description has been made with regard to a black-and-white printer, the same is the case with a color printer, as a matter of course.

However, a line printer that employs a line head based on the serial input system needs to generate and transfer an ON/OFF signal every time printing for each particular gradation scale is to be carried out, as has been described above, and it takes time to transfer the ON/OFF signal. Accordingly, the time required for printing is undesirably long, and thus the line printer employing a serial input type line head cannot comply with the demand for a reduction in the printing time, which has been particularly demanded in recent years. Particularly, there has been a tendency for the number of head elements to increase in recent years. Therefore, the time required to transfer the ON/OFF signal tends to increase, and the printing time tends to lengthen.

Meanwhile, line printers that employ a line head based on a parallel input system have recently been developed. According to the parallel input system, pixel density data for one line is transferred to the head part at one time to carry out printing, thereby enabling the printing time to be shortened to a considerable extent because it is not necessary to transfer an ON/OFF signal as in the case of the serial input system.

However, the line head based on the parallel input system also involves the problem of common resistance unevenness that occurs owing to the variation in the number of heating elements in the same way as in the case of the serial input system. Accordingly, the parallel input type line head also needs to correct density variation caused by the common resistance.

However, since no ON/OFF signal is transferred in the parallel input system, it is impossible to adopt the technique of counting the number of elements to be heated by using a counter as in the case of the serial input system.

SUMMARY OF THE INVENTION

Under the above-described circumstances, an object of the present invention is to provide a line printer that employs a line head based on the parallel input system, in which there are provided a plurality of tables containing data concerning the pulse width of an STB pulse which corresponds to each particular gradation scale, and a common table is selected according to the number of elements to be heated, thereby effectively correcting a density variation caused by the common resistance.

To attain the above-described object, the present invention provides a line printer which includes a device for receiving gradation scale values of pixels for one line to be printed, and a plurality of tables for correcting a density variation caused by common resistance unevenness. The line printer further includes a device for arithmetically obtaining a number of printing elements to be operated for each gradation scale for printing from the gradation scale values of the pixels for one line received by the receiving device, and a device for retrieving an optimal table from the plurality of tables on the basis of the number of printing elements obtained by the arithmetic device.

The line printer of the present invention is provided with a plurality of tables for correcting a density variation caused by the common resistance. The receiving device receives gradation scale values, that is, density values, of pixels for one line to be printed.

When the receiving device receives gradation scale values of pixels for one line, the arithmetic device obtains a number of printing elements to be operated for each gradation scale for printing from the gradation scale values of the pixels for one line received by the receiving device.

The retrieving device obtains an optimal table from the plurality of tables on the basis of the number of printing elements obtained by the arithmetic device.

With the above-described arrangement, a common table can be selected from among a plurality of tables even in a line printer that employs a line head based on the parallel input system, in which gradation scale values of pixels for one line are received at one time. Accordingly, it is possible to effectively correct a density variation caused by the common resistance.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIGS. 4A and 4B are waveform charts used to explain an ON/OFF signal in the arrangement shown in FIG. 3.

FIG. 5 shows an example of the arrangement of a look-up table.

DESCRIPTION OF THE PREFERRED EMBODIMENT

One embodiment of the present invention will be described below with reference to the accompanying drawings. It should be noted that, although the present invention can also be applied to a color line printer, as a matter of course, in the following embodiment the present invention will be described by way of an example in which it is applied to a black-and-white printer that employs a line head based on the parallel input system, with a view to facilitating the understanding of the present invention.

Figure 1:
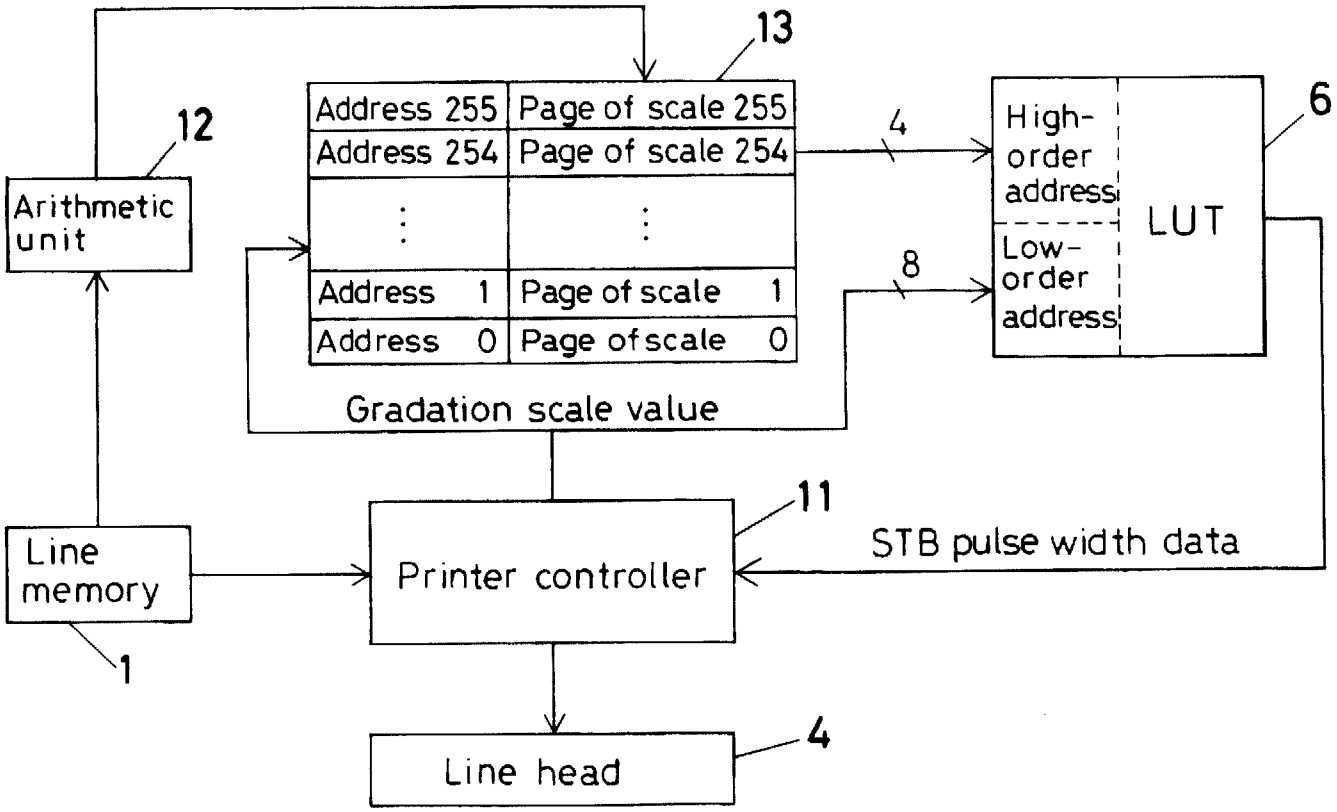
FIG. 1 is a block diagram showing the arrangement of one embodiment of the present invention.
Figure 2A:
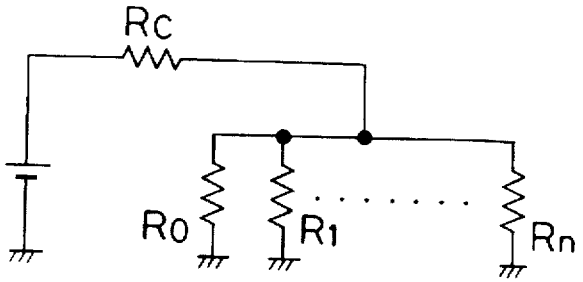
FIGS. 2A and 2B are equivalent circuit diagrams used to explain density variation caused by a common resistance.
Figure 2B:
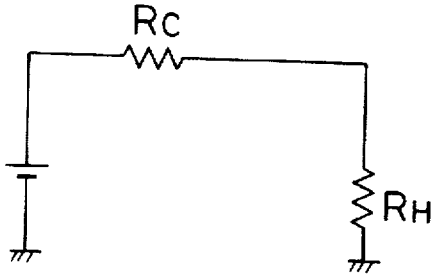

FIG. 1 is a block diagram showing the arrangement of one embodiment of the line printer according to the present invention. In the figure, reference numeral 11 denotes a printer controller, 12 an arithmetic unit, and 13 a common page table.

Figure 3:
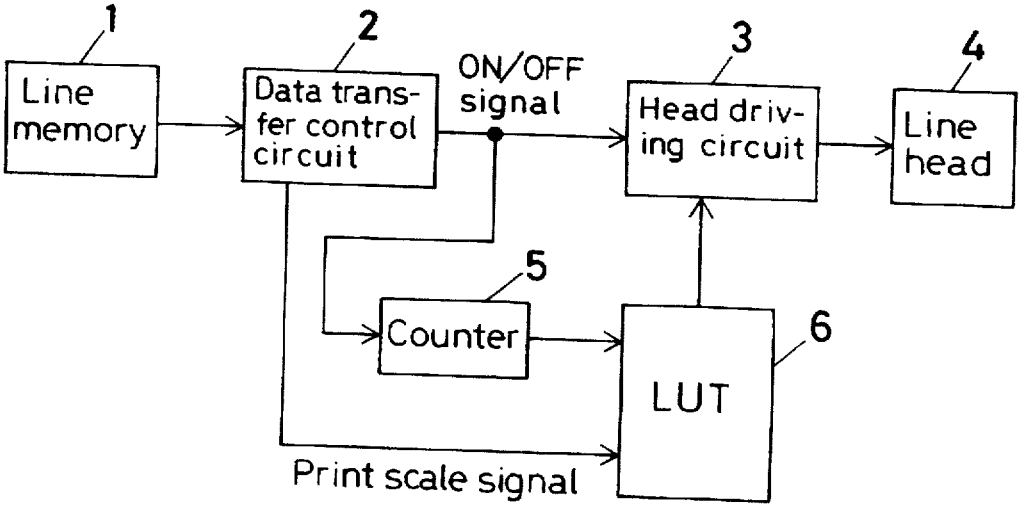
FIG. 3 PRIOR ART
FIG. 3 is a block diagram showing an example of an arrangement for correcting density variation caused by a common resistance in a conventional line printer that employs a line head based on a serial input system.

It should be noted that constituent elements in FIG. 1 which are equivalent to those shown in FIG. 3 are denoted by the same reference numerals. That is, it is assumed in this embodiment that there are 256 gradation scales 0 to 255, and the number of elements constituting the line head 4 is 2,560. Further, it is assumed that the LUT 6 has the arrangement shown in FIG. 5, and that: when the number of heating elements is in the range of from 0 to 255, the table with the page address 0 is used; when the number of heating elements is in the range of from 256 to 511, the table with the page address 1 is used; when the number of heating elements is in the range of from 512 to 767, the table with the page address 2 is used; when the number of heating elements is in the range of from 768 to 1,023, the table with the page address 3 is used; when the number of heating elements is in the range of from 1,024 to 1,279, the table with the page address 4 is used; when the number of heating elements is in the range of from 1,280 to 1,535, the table with the page address 5 is used; when the number of heating elements is in the range of from 1,536 to 1,791, the table with the page address 6 is used; when the number of heating elements is in the range of from 1,792 to 2,047, the table with the page address 7 is used; when the number of heating elements is in the range of from 2,048 to 2,303, the table with the page address 8 is used; and when the number of heating elements is in the range of from 2,304 to 2,560, the table with the page address 9 is used.

Referring to FIG. 1, the line memory (1-line buffer memory) 1 is stored with gradation scale values, that is, density values, of pixels for one line which are read out from a frame memory (not shown). The printer controller 11 controls the printing operation of the parallel input type line printer.

The arithmetic unit 12 executes predetermined arithmetic processing upon detecting that density values of pixels for one line to be printed have been written on the line memory 1. The arithmetic unit 12 executes an arithmetic operation for obtaining a number of elements to be heated during printing carried out for each particular gradation scale on the basis of the gradation scale value data received by the line memory 1. More specifically, the arithmetic unit 12 operates as follows:

First, the arithmetic unit 12 obtains numbers of data items $n_0, n_1, \ldots, n_i, \ldots, n_{255}$ for all the gradation scales from the received data concerning the gradation scale values. It should be noted that $n_0$ is the number of data items whose gradation scale value is 0, and $n_1$ is the number of data items whose gradation scale value is 1. The same is the case with the other numbers of data items.

Thus, a histogram showing the number of data items for each particular gradation scale can be made. Next, the arithmetic unit 12 calculates a number of elements to be heated during printing carried out for each particular gradation scale by using the histogram according to the following expression:

$$N_i = n_i + n_{i+1} + n_{i+2} + \ldots + n_{254} + n_{255}$$

where $N_i$ is the number of elements to be heated during printing for the scale i, and $0 \leq i \leq 255$.

It will be clear that the number of elements to be heated during printing for the scale i can be obtained from the above expression. The reason for this is as follows: Elements corresponding to pixels whose gradation scale value is k ($0 \leq k \leq 255$) heat up during printing for scales up to k, but do not heat up during printing for scales (k+1) and higher.

Therefore, during printing for the scale k, all elements corresponding to pixels whose gradation scale value is k or more heat up.

After obtaining a number of elements to be heated during printing for each particular gradation scale in this way, the arithmetic unit 12 writes the values of the obtained numbers of elements to be heated, or predetermined bits of the values of the numbers of elements to be heated, in the corresponding gradation scale page columns of the common page table 13. In this case, it is assumed that the high-order 4 bits of the value of each number of elements to be heated is written.

Accordingly, in this case, the arithmetic unit 12 writes the high-order 4 bits of $N_0$ in the column "page of scale 0" of the common page table 13, and also writes the high-order 4 bits of $N_1$ in the column "page of scale 1" of the common page table 13. For the scales 2 and higher, the arithmetic unit 12 similarly writes the high-order 4 bits of the value of each number of elements to be heated in the corresponding gradation scale page column of the common page table 13. When the high-order 4 bits of $N_{255}$ has been written in the column "page of scale 255" of the common page table 13, the process of writing to the common page table 13 is terminated.

Thus, if $N_0$=2,400, for example, $9_H$ is written in the column "page of scale 0" of the common page table 13. IF $N_1$=2,100, $8_H$ is written in the column "page of scale 1" of the common page table 13.

Upon completion of the writing to the common page table 13, the processing executed by the arithmetic unit 12 is terminated. Then, the arithmetic unit 12 posts the termination of the processing to the printer controller 11.

On receipt of notice of the termination of the processing from the arithmetic unit 12, the printer controller 11 fetches gradation scale value data from the line memory 1, and parallel-transfers the data to the line head 4, thus starting a printing operation. When printing is to be carried out for each particular gradation scale, the printer controller 11 outputs the gradation scale value to both the common page table 13 and the LUT 6, and selects a common table which is to be used in printing for the relevant scale. Then, the printer controller 11 obtains STB pulse width data for the relevant scale from the common table.

More specifically, the printer controller 11 outputs 00H when printing for the scale 0 is to be carried out. Consequently, the address 0 in the common page table 13 is accessed, and thus the value written in the column "page of scale 0" is read out and used as a high-order address in the LUT 6. For example, if $N_0$=2,400, as described above, since $9_H$ has been written in the column "page of scale 0" of the common page table 13, the value $9_H$ is used as a high-order address in the LUT 6.

Since, at this time, $00_H$ is inputted to the low-order address terminal of the LUT 6 from the printer controller 11, the table with the page address 9 is selected as a common table from the LUT 6, and STB pulse width data corresponding to the scale 0 is read out from the table.

Then, the printer controller 11 drives the line head 4 by using the STB pulse width data to effect printing for the scale 0. It should be noted that, since the arrangement and printing operation of the printer controller 11 are well known, detailed description thereof is omitted.

Upon completion of the printing for the scale 0 in this way, the printer controller 11 carries out printing for the scale 1. In this case, the printer controller 11 outputs $01_H$. Consequently, the address 1 in the common page table 13 is accessed, and thus the value written in the column "page of scale 1" is read out and used as a high-order address in the LUT 6. For example, if $N_1$=2,100, as described above, since $8_H$ has been written in the column "page of scale 1" of the common page table 13, the value $8_H$ is used as a high-order address in the LUT 6.

Since, at this time, $01_H$ is inputted to the low-order address terminal of the LUT 6 from the printer controller 11, the table with the page address 8 is selected as a common table from the LUT 6, and STB pulse width data corresponding to the scale 1 is read out from the table.

Then, the printer controller 11 drives the line head 4 by using the STB pulse width data to effect printing for the scale 1.

The printer controller 11 repeats the above-described operation until printing for the scale 255 is carried out. Thus, printing for the one line concerned is completed.

Then, when gradation scale value data for the next line is written in the line memory 1, the above-described operation is executed on the basis of the gradation scale value data, and thus printing of this line is carried out.

Although the present invention has been described by way of one embodiment, it should be noted that the present invention is not necessarily limited to the described embodiment, and that various changes and modifications may be imparted thereto. For example, although thermal elements are employed in the described embodiment, the present invention may generally be applied to line printers in which the common resistance gives rise to a problem, in addition to line printers that employ thermal elements.

As will be clear from the foregoing description, the present invention makes it possible to correct a density variation caused by the common resistance even in a line printer based on the parallel input system, by providing a plurality of tables containing data concerning an STB pulse width for each particular gradation scale, and selecting a common table according to the number of elements to be heated.

Further, since the present invention can be applied not only to a line printer that employs thermal elements but also to a line printer in which the common resistance gives rise to a problem, the term of system design for line printers and the development cost therefor can be reduced to a considerable extent by integrating the receiving device, the arithmetic unit, and the retrieving device into an IC using a gate array, etc.

What we claim is:

1. A line printer comprising:

means for receiving gradation scale values of pixels for one line to be printed;

memory means for storing a plurality of tables for correcting a density variation caused by common resistance unevenness;

arithmetic means, coupled to said means for receiving, for arithmetically obtaining a number of printing elements to be operated for each particular gradation scale value for printing from the gradation scale values of the pixels for one line received by said receiving means;

storage means, coupled to said arithmetic means, for storing the number of printing elements to be operated as obtained by said arithmetic means for each particular gradation scale value; and means for retrieving an optimal table from said plurality of tables stored in said memory means on the basis of the number of printing elements obtained by said arithmetic means stored in said storage means and the gradation scale values, the gradation scale values being provided from said means for receiving to said printing elements in parallel for printing.

2. The line printer of claim 1, wherein said means for retrieving retrieves an optimal table from said memory means using a gradation scale value as a low order address and a number of printing elements stored in said storage means for the gradation scale value as a high order address.

3. The line printer of claim 1, wherein said plurality of tables comprise pulse width data for the printing elements for each particular gradation scale value based on the number of printing elements to be operated.

4. A line printing method for a line printer having plural printing elements comprising the steps of:

a) receiving gradation scale values of pixels for a line to be printed;

b) storing a plurality of tables for correcting a density variation caused by common resistance unevenness;

c) determining arithmetically a number of printing elements to be operated for printing for each particular gradation scale value based upon the gradation scale values for the line to be printed received in said step a);

d) storing the number of printing elements determined for each particular gradation scale value in said step c);

e) retrieving an optimal table for each gradation scale value to be printed from the plurality of tables stored in said step b) based upon the number of printing elements stored in said step d) and the gradation scale values received in said step a); and f) printing the line based upon the optimal tables retrieved in said step e), the gradation scale values received in said step a) being provided to the printing elements in parallel for printing in said step f).

5. The line printing method of claim 4, wherein said step e) comprises retrieving an optimal table using a gradation scale value as a low order address and a number of printing elements stored in said step d) for the gradation scale value as a high order address.

6. The line printing method of claim 4, wherein the plurality of tables comprise pulse width data for the printing elements for each particular gradation scale value based on the number of printing elements to be operated.

7. A line printing system for a line head having a plurality of heating elements and capable of printing with a plurality of gradation scale values comprising:

memory means for storing received gradation scale values of pixels for a line to be printed;

arithmetic means, coupled to said memory means, for determining a number of heating elements to be heated for each of the gradation scale values for the line to be printed based upon the gradation scale values stored in said memory means;

storage means for storing a plurality of tables for correcting a density variation in a printed line caused by common resistance unevenness;

second storage means for storing the number of heating elements to be heated as determined by said arithmetic means for each of the gradation scale values; and control means, coupled to the line head, for retrieving an optimal table for each gradation scale value for the line to be printed from said storage means based upon a gradation scale value and the number of heating elements to be heated for the gradation scale value stored in said second storage means and for controlling the line head to print the line in accordance with the retrieved optimal tables, the gradation scale values being provided from said memory means to the line head in parallel for printing.

8. The line printing system of claim 7, wherein said control means retrieves an optimal table from said storage means using a gradation scale value as a low order address and a number of heating elements for the gradation scale value stored in said second storage means as a high order address.

9. The line printing system of claim 7, wherein said plurality of tables comprise pulse width data for the heating elements for each gradation scale value based on the number of heating elements to be heated.

10. A line printing method for a line head having a plurality of heating elements and capable of printing with a plurality of gradation scale values comprising the steps of:

a) storing received gradation scale values of pixels for a line to be printed;

b) determining a number of the heating elements to be heated for each of the gradation scale values for the line to be printed based on the stored gradation scale values;

c) storing the number of heating elements to be heated as determined in said step b);

d) storing a plurality of tables for correcting a density variation in a printed line caused by common resistance unevenness;

e) retrieving an optimal table for each gradation scale value for the line to be printed based upon a gradation scale value and the number of heating elements to be heated for the gradation scale value as stored in said step c); and f) controlling the line head to print the line in accordance with the retrieved optimal tables, the gradation scale values stored in said step a) being provided in parallel to the line head for printing in said step f).

11. The line printing method of claim 10, wherein said step e) comprises retrieving an optimal table using a gradation scale value as a low order address and a number of printing elements stored in said step c) for the gradation scale value as a high order address.

12. The line printing method of claim 10, wherein the plurality of tables comprise pulse width data for the heating elements for each particular gradation scale value based on the number of heating elements to be heated.

* * * * *